United States Patent [19]

Maguire

[11] Patent Number: 4,606,710

[45] Date of Patent: Aug. 19, 1986

[54] PERISTALTIC PUMP

[76] Inventor: Stephen B. Maguire, 400 W. Knowlton Rd., Media, Pa. 19063

[21] Appl. No.: 785,665

[22] Filed: Oct. 9, 1985

[51] Int. Cl.[4] ..... F04B 43/12

[52] U.S. Cl. ..... 417/477

[58] Field of Search ..... 417/477, 475

[56] References Cited

U.S. PATENT DOCUMENTS

| | | | |
|---|---|---|---|
| 3,249,059 | 5/1966 | Renn | 417/477 |
| 4,113,409 | 9/1978 | Rossmanith | 417/477 |
| 4,211,519 | 7/1980 | Hogan | 417/477 X |
| 4,315,718 | 2/1982 | Hogan | 417/477 |

FOREIGN PATENT DOCUMENTS

| | | | |
|---|---|---|---|
| 58-187593 | 11/1983 | Japan | 417/477 |

*Primary Examiner*—Richard E. Gluck

*Attorney, Agent, or Firm*—Robert K. Youtie

[57] ABSTRACT

A peristaltic pump including an outer casing rotatably receiving a cage carrying rollers for planetary movement, the rollers extending radially outwardly and inwardly beyond the cage, a flexible tube interposed between the casing and rollers for peristaltic flexure upon roller motion, and a central rotary drive in driving engagement with the rollers for effecting motion of the latter.

11 Claims, 5 Drawing Figures

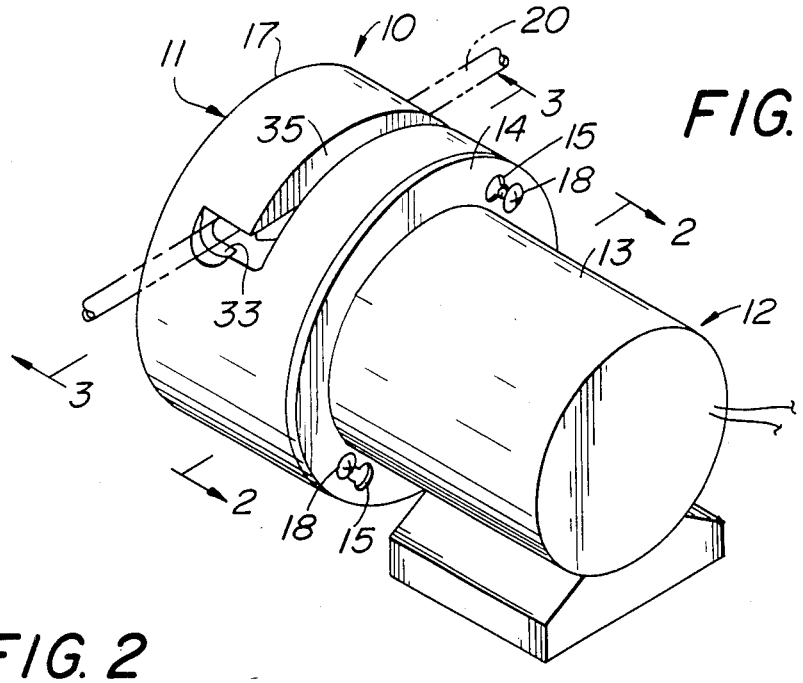
FIG. 1
FIG. 2
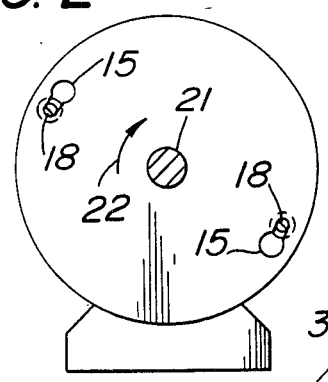
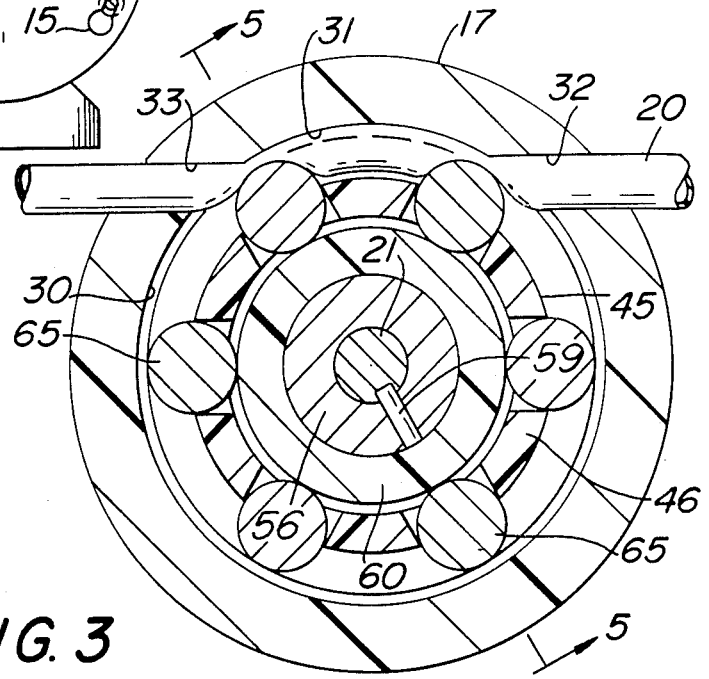
FIG. 3

PERISTALTIC PUMP

BACKGROUND OF THE INVENTION

In the field of peristaltic pumps it is known to provide a circular array of rollers driven in planetary motion against a flexible tube to effect peristaltic pumping. The prior art of which applicant is aware is listed below:

| U.S. PAT. NO. | PATENTEE |
|---|---|
| 2,899,904 | BECHER |
| 3,358,609 | WORTH ET AL. |
| 3,366,071 | DUTLER |
| 3,816,035 | MALBEC |
| 4,113,409 | ROSSMANITH |

However, there are certain objections to the prior art, including difficulty in insertion and removal of the peristaltic tube; difficulty in mounting the pump to a prime mover; complex fabrication of roller cage; complexity and expense of rotary and thrust bearings; versatility of orientation of the pump relative to a drive motor; and others.

SUMMARY OF THE INVENTION

It is among the important objects of the present invention to provide a peristaltic pump of the type described which provides a simple formation in the outer housing for quick and easy insertion and removal of the peristaltic tube; wherein the pump is quickly and easily engaged in driven relation with a motor shaft and selectively oriented relative to the motor, as desired; wherein a roller cage is of extremely simple and durable unitary construction; which employs unique rotary and thrust bearings effecting substantial savings in cost and minimizing wear; wherein a simple frictional tube effectively drives the rollers in their planetary motion; and which further accomplishes its intended objects.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claim.

BRIEF DESCRIPTION OF THE DRAWINGS

FIG. 1 is a top perspective view showing a pump or pump head of the present invention in operative association with a driving motor.

FIG. 2 is a transverse sectional view taken generally along the line 2—2 of FIG. 1.

FIG. 3 is a transverse sectional view taken generally along the line 3—3 of FIG. 1.

DESCRIPTION OF THE PREFERRED EMBODIMENT

Figure 4:
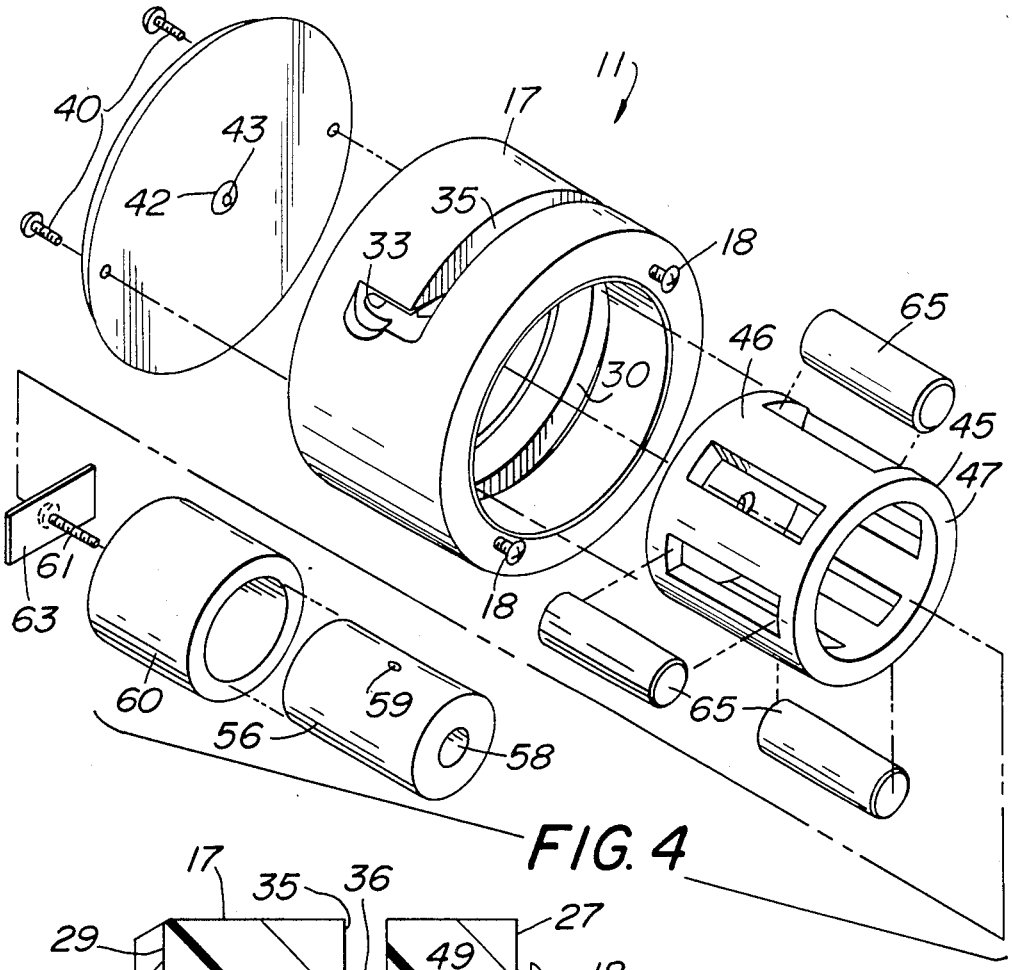
FIG. 4 is an exploded perspective view showing the pump or pump head construction of the present invention.

Referring now more particularly to the drawings, and specifically to FIGS. 1 and 2 thereof, a motor-pump is there generally designated 10, including a pump head or pump per se 11 and a prime mover or drive motor 12.

It may there be seen that the motor 12 or motor housing 13 may include a radial flange 14 having one or more key hole-shaped slots, openings or receivers 15. In the illustrated embodiment there are shown two receivers 15 at diametrically opposed locations, but a greater or lesser number may be employed, as desired.

The pump 11 includes a generally cylindrical outer casing 17 having one end generally concentric with and adjacent to the motor housing flange 14. One or more abutment members or headed projections 18, such as machine screws, may extend from the adjacent end of pump casing 17 through and beyond the motor housing receivers or slots 15.

As will appear more fully hereinafter, the pump 11 is adapted to be mounted to the motor 12 by insertion of the headed fasteners 18 through the enlarged regions of the keyhole shaped openings or receivers 15, after which the pump is rotated to engage the shanks of headed projections 18 in the narrower regions of receivers 15, the enlarged ends or heads of the projections retaining the pump against withdrawal from the motor. Also, the rotation of the pump, as will be more fully understood hereinafter, assures location of the headed fasteners 18 in their pump retaining relation with the motor. In the illustrated relationship of pump 11 and motor 12, the pump tubing 20 is shown as in an upper location. Upon reorientation of the pump casing 17, say rotation approximately 180° to locate the fasteners 18 in the opposite receivers 15, the pump tube 20 would be located in a lower position. Obviously, a plurality of receivers 15 may be arranged to locate the pump outer casing 17 and tubing 20 in any desired orientation.

In FIG. 2 is shown the motor drive shaft 21 which turns generally clockwise in the direction of arrow 22, to retain the fasteners 18 in the receivers 15. While the receivers are illustrated as key hole-shaped slots, it is appreciated that the receivers may be of other suitable configuration, having an end edge or wall 23 for limiting abutting engagement with the associated projection 18 to limit pump casing rotation, and being suitably undercut or configured to engage beneath the head of the received fastener 18 to limit withdrawal of the pump 11 from the motor 12.

Figure 5:
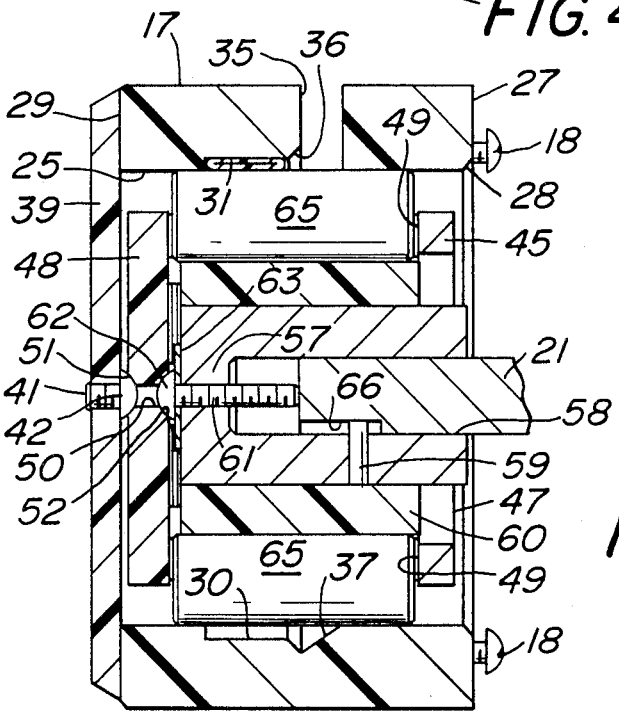
FIG. 5 is a longitudinal sectional view taken generally along the line 5—5 of FIG. 3.

The pump 11 is best seen in FIG. 4, the outer casing 17 being there illustrated as generally cylindrical, both internally and externally. That is, the outer casing is an open ended cylinder having a cylindrical internal surface 25, and a concentric cylindrical external surface 26. The fasteners 18 may project from the end wall or surface 27 of the outer casing 17, which may have its inner edge chamfered, as at 28, to the inner cylindrical surface 25. The opposite end surface of the outer casing 17 is designated 29; and, spaced between the end surfaces 27 and 29, the inner cylindrical surfaces is formed with an annular internal groove 30. At angularly spaced location along the groove 30, as at opposite ends of a sector 31 of the groove, there are formed through passageways or openings 32 and 33 communicating between the groove 30 and the exterior of the casing through the cylindrical wall thereof. As best seen in FIG. 3, the openings or passageways 32 and 33 may be generally aligned with each other, approximately chordally of the casing at opposite ends of the groove sector 31. Along and coextensive with the groove sector 31 is a slot 35 opening radially through the cylindrical wall of casing 17 and communicating at opposite ends with the passageways 32 and 33, respectively. Further, the outer casing 17 may be cut away, as by a bevel or chamfer 36 coextensive with the slot 35 and extending obliquely between the latter and the groove sector 31. This is best seen in FIG. 5, illustrating lateral communication between the slot 35 and groove sector 31, for a purpose appearing presently. Also seen in FIG. 5 is an internal groove 37 of generally triangular cross-sectional configuration which opens into the groove 30 and, along the sector 31, provides the bevel 36. While the drawings herein illustrate a machined outer casing, and other components, it is appreciated that the various parts may be otherwise formed, as by molding, or as desired.

Extending across and in closing relation with one end of the outer casing 17 is a generally circular end member or wall 39. The end member 39 may abut the end surface 29 of the outer casing 17, being suitably secured thereto by any desired means, such as fasteners 40. Centrally of the casing end member 39 is a fastener or bolt 41 having its shank threaded axially through the end member and its enlarged inner end or head 42 on the inner side of the end member. The head 42 may be of the round type, and divided with a central recess 43, as for a wrench.

Interiorly of the outer casing 17, spaced concentrically therein, is a generally cylindrical or annular cage 45. The cage 45 may include a generally cylindrical wall 46 having one end open, as at 47, and the other end closed by an end member or wall 48. The cylindrical wall 46 may be provided with a series of elongate through slots or openings 49 arranged in equally angularly spaced relation circumferentially about the cylindrical wall. The through openings 49 may all be substantially identical, elongate longitudinally of the cylindrical wall 46, and longitudinally coextensive with each other, terminating proximate to the cage end number 48 and spaced inwardly from the cylindrical surface 47. In assembly, the annular or cylindrical cage 45 is arranged concentrically of and in spaced relation within the outer casing 17.

The cage end wall 48 is formed centrally thereof with a through bore or hole 50. That is, the bore 50 opens through opposite sides of the end member 48 outwardly toward the casing end member 39 and inwardly of the cage. The open ended bore 50 is countersunk or recessed at its opposite ends, as by an outer countersink or recess 51, and by an inner countersink or recess 52. The countersink or recess 51 provides a socket rotatably receiving and in bearing relation with the head 42 with the cage end member 48 in adjacent, spaced relation with the casing end member 39, as best seen in FIG. 5. The inner bore end recess or countersunk 52 also defines a socket in receiving relation with a bearing member or head, as will appear presently.

A rotary drive is generally designated 55, and includes a hollow cylindrical cup or arbor 56 having one end closed by an end wall 57. The arbor 56 is provided with a concentric internal hollow 58 of cylindrical configuration, being closed at one end by the wall 57 and open at its other end, rightward as seen in FIG. 5. A radial key pin 59 is fixed in the arbor 56 and projects radially partially into the arbor hollow 58, see FIG. 5. Closely surrounding the arbor 56 is a frictional sleeve 60 of resiliently yieldable, high friction material. The sleeve 60 has been advantageously fabricated of urethane for its resilience, frictional character and wear. The frictional sleeve 60 is of an internal diameter to snugly and frictionally engage about the arbor 56, and of an external diameter slightly less than the internal diameter of the cage wall 46.

A headed fastener, such as a bolt 61 is threaded concentrically inwardly through arbor end wall 57 into the arbor hollow 58. The bolt 61 may include an enlargement or head 62 of the round type externally of the arbor end wall 57 in abutting engagement with a bearing plate 63 clamped by the head in facing engagement with the arbor end wall 57 and the adjacent end surface of friction sleeve 60. The fastener head 62 engages in bearing relation in the recess or socket 52 of the bore 50 to rotatably support and locate the rotary drive 55 relative to the cage end wall 48. In addition, there are located in each cage opening 49 a generally cylindrical member or roller 65. The rollers 65 are each loosely received in a respective opening 49, being of a diameter to extend radially inwardly beyond cylindrical cage wall 46 into bearing engagement with the external surface of frictional sleeve 60, and to extend radially outwardly into bearing engagement with the internal cylindrical surface 25 of outer casing 17. The sleeve 60, by its resilience, is compressed to maintain the rollers in frictional engagement with the outer casing wall, and by its high frictional characteristic to effectively insure rolling of the rollers along the interior of the outer casing wall, all upon rotation of the drive 55.

Mounting of the pump 11 to the motor 12 is extremely simple, requiring only sliding engagement of the rotary drive 55 to receive the motor drive shaft 21 in the arbor hollow 58 with the pin 59 engaging in the drive shaft keyway 66. Entry of the drive shaft 21 into the arbor hollow 58 is limited by shaft engagement with the inner end of bolt 61. This limited entry permits interengagement of the headed fasteners or abutment members 18 with their receivers or slots 15, as described hereinbefore. Rotation of the drive shaft 21 is of a direction to maintain interengagement between the headed abutment members 18 and receiving slots 15.

In the operative condition of use, the flexible peristaltic tube 20 extends in one casing opening, say opening 32, along the sector formation 31, and exits through the casing opening 33. Thus, upon rotation of the shaft 21 counterclockwise as seen in FIG. 3 (viewed oppositely from FIG. 2), the rollers 65 are caused to orbit about the axis of shaft 21 and roll in squeezing engagement with the tube 20 between openings 32 and 33 to effect peristaltic pumping. When it is desired to remove and replace the tube 20, this may be done without disassembly of the pump by lateral displacement of the tube along the chamfered edge 36, through openings 32 and 33, and radially outwardly through a slot 35. A replacement tube may be squeezed into place by reversal of the above described procedure.

In addition to the above described ease of mounting and removal of the pump 11 with respect to the motor 12, and of the removal and replacement of the tubing 20 with respect to the pump, the assembly has been found extremely simple and highly reliable, the head 42 and socket 51 defining a thrust and radial bearing, as well as the head 62 and socket 52 defining a thrust and radial bearing, and combining with the rollers 65 to effectively maintain all necessary clearances between the moving parts for a maximum useful life.

It has also been found that the frictional sleeve 60 of cast urethane effectively retains its position against the arbor 56 without the need of adhesive or other fastening; and also that the frictional sleeve effectively and reliably drives by its frictional engagement with both the arbor and the rollers 65. The metal plate or tab 63 abutting the ends of both the arbor 56 and sleeve 60 serves to hold the latter on the former.

From the foregoing it is seen that the present invention provides a peristaltic pump which is extremely simple in construction, durable and reliable throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A peristaltic pump comprising an outer casing, an annular cage centrally in said casing, cage mounting means mouting said cage for rotation in said casing, an annular array of rollers carried by said cage for planetary motion rotating with said cage and relative to said cage, said rollers being dimensioned to project both radially inwardly of and outwardly beyond said cage, a rotary drive in said cage in driving engagement with said rollers for rotating the latter in said planetary motion, drive mounting means mounting said drive in said cage, and flexible tubing interposed between said casing and rollers for peristaltic squeezing of said tubing by successive rollers upon said planetary motion, said casing having an internal sector formation for receiving said flexible tubing, said casing having through openings at opposite ends of said formation for passing spaced locations of said tubing through said casing, and said casing having a through slot along said sector formation for lateral insertion and withdrawal of said tube into and out of said formation and openings.

2. A peristaltic pump comprising an outer casing, an annular cage centrally in said casing, cage mounting means mounting said cage for rotation in said casing, an annular array of rollers carried by said cage for planetary motion rotating with said cage and relative to said cage, said rollers being dimensioned to project both radially inwardly of and outwardly beyond said cage, a rotary drive in said cage in driving engagement with said rollers for rotating the latter in said planetary motion, drive mounting means mounting said drive in said cage, and flexible tubing interposed between said casing and rollers for peristaltic squeezing of said tubing by successive rollers upon said planetary motion, said casing including an end member, said cage including an end member adjacent to said casing end member, and said cage mounting means comprising cage bearing means interposed between said casing and cage end members.

3. A peristaltic pump according to claim 2, said cage bearing means comprising complementary head and socket means on said casing and cage end members.

4. A peristaltic pump comprising an outer casing, an annular cage centrally in said casing, cage mounting means mounting said cage for rotation in said casing, an annular array of rollers carried by said cage for planetary motion rotating with said cage and relative to said cage, said rollers being dimensioned to project both radially inwardly of and outwardly beyond said cage, a rotary drive in said cage in driving engagement with said rollers for rotating the latter in said planetary motion, drive mounting means mounting said drive in said cage, and flexible tubing interposed between said casing and rollers for peristaltic squeezing of said tubing by successive rollers upon said planetary motion, said cage including an end member, and said drive mounting means comprising drive bearing means interposed between said cage end member and drive.

5. A peristaltic pump according to claim 4, said drive bearing means comprising complementary head and socket means on said drive and cage end member.

6. A peristaltic pump according to claim 5, said casing including an end member adjacent to said cage end member, and said cage mounting means comprising cage bearing means interposed between said casing and cage end members.

7. A peristaltic pump according to claim 6, said cage bearing means comprising additional complementary head and scoket means on said casing and cage end members.

8. A peristaltic pump according to claim 7, said additional head and socket means comprising a head on said casing end member and a socket on the exterior of said cage end member rotatably receiving the head on said casing end member, and said first mentioned head and socket means comprising a head on said drive and a socket on the interior of said cage end member rotatably receiving the head on said drive.

9. A peristaltic pump comprising an outer casing, an annular cage centrally in said casing, cage mounting means mounting said cage for rotation in said casing, an annular array of rollers carried by said cage for planetary motion rotating with said cage and relative to said cage, said rollers being dimensioned to project both radially inwardly of and outwardly beyond said cage, a rotary drive to said cage in driving engagement with said rollers for rotating the latter in said planetary motion, drive mounting means mounting said drive in said cage, and flexible tubing interposed between said casing and rollers for peristaltic squeezing of said tubing by successive rollers upon said planetary motion, said drive comprising an arbor, and a frictional sleeve on said arbor in substantially non-slip engagement with said arbor and rollers, said arbor having a hollow extending inwardly from one end, and a pin in said hollow for nonrotative engagement with a drive shaft received in said hollow.

10. A peristaltic pump according to claim 9, in combination with a prime mover including said drive shaft in nonrotative engagement in said arbor hollow, and abutment means on said casing in limiting abutting engagement with said prime mover, to retain said casing against rotation when said cage rotates.

11. A peristaltic pump according to claim 10, said abutment means comprising a headed projection and an undercut receiver on said casing and prime mover retaining the casing against withdrawal and rotation.

* * * * *